US005624024A

United States Patent [19]

Miess

[11] Patent Number: 5,624,024

[45] Date of Patent: Apr. 29, 1997

[54] CONCESSION CUP CARRIER

[75] Inventor: Kenneth Miess, Lilburn, Ga.

[73] Assignee: The Mead Corporation, Dayton, Ohio

[21] Appl. No.: 493,447

[22] Filed: Jun. 22, 1995

Related U.S. Application Data

[63] Continuation-in-part of Ser. No. 283,874, Aug. 1, 1994, abandoned.

[51] Int. Cl.[6] ..... B65D 85/62

[52] U.S. Cl. ..... 206/172; 206/193; 206/199

[58] Field of Search ..... 206/427, 429, 206/161, 162, 170, 171, 172, 173, 174, 175, 193, 194, 196, 197, 199

[56] References Cited

U.S. PATENT DOCUMENTS

| | | | |
|---|---|---|---|
| 2,302,677 | 11/1942 | Crane | 206/170 |
| 2,352,121 | 6/1944 | Readeker | 206/196 |
| 2,563,065 | 8/1951 | Price | 206/171 |
| 2,576,179 | 11/1951 | Holy | 206/162 |
| 2,827,165 | 3/1958 | Gentry | 206/434 |
| 3,255,919 | 6/1966 | Koolnis | 206/143 |
| 3,367,557 | 2/1968 | Farquhar | 206/140 |
| 3,397,776 | 8/1968 | Weiss | 206/431 |
| 3,495,734 | 2/1970 | Hanna et al. | 206/171 |
| 3,687,281 | 8/1972 | Prot | 206/430 |
| 3,744,704 | 7/1973 | Struble | 206/194 |
| 3,773,214 | 11/1973 | Lemon | 206/194 |
| 3,780,906 | 12/1973 | Katzenmeyer | 206/170 |
| 3,868,140 | 2/1975 | Gordon | 294/87.2 |
| 4,155,502 | 5/1979 | Forte | 294/146 |
| 4,196,807 | 4/1980 | Brom | 206/427 |
| 4,645,072 | 2/1987 | Lemon | 206/199 |
| 4,706,814 | 11/1987 | Baugus et al. | 206/427 |
| 4,836,367 | 6/1989 | Golkar | 206/200 |
| 5,044,498 | 9/1991 | Galiegue et al. | 206/429 |

*Primary Examiner*—Jacob K. Ackun
*Attorney, Agent, or Firm*—Tsugihiko Suzuki

[57] ABSTRACT

A collapsible carrier for tapered articles is disclosed. The carrier includes a pair of upright handle panels secured together in a face-to-face contacting relationship, a pair of divergent upper panels foldably joined respectively to the lower edges of the handle panels, and a pair of convergent lower panels foldably interconnected with the upper panels to form in cooperation with the upper panels a tubular structure. Each upper panel has an article-receiving aperture. Each lower panel also has an article-receiving aperture. The receiving aperture in each upper panel is vertically aligned with that in the adjacent lower panel. The summation of the widths of the lower panels is less than that of the widths of the upper panels so that the tubular structure is prevented from collapsing flat when at least one of the vertically aligned pairs of the receiving apertures are loaded with an article.

19 Claims, 8 Drawing Sheets

CONCESSION CUP CARRIER

This is a continuation in part of application Ser. No. 08/283,874 filed Aug. 1, 1994, and now abandoned.

BACKGROUND OF THE INVENTION

The present invention relates generally to article carriers and, more particularly, to a carrier for carrying articles such as drinking cups used in concession stands and quick food outlets.

Hand held carriers of a variety of designs are in use for transporting articles through short distances. They are aimed primarily at facilitating stable transporting of articles such as liquid filled containers. For example, U.S. Pat. No. 4,196,807 to Brom discloses a carrier having a central handle portion, a pair of divergent upper panels, and a pair of convergent lower panels. Each one of the upper and lower panels is provided with apertures. Each aperture in the upper panels is vertically aligned with the adjacent aperture in the lower panels to receive and hold a tapered drinking cup in a upright condition. U.S. Pat. No. 3,744,704 to Struble discloses a carrier for similar purposes having a partition with a locking means and a medial strip interposed between each upper panel and the adjacent lower panel. U.S. Pat. No. 3,780,906 to Katzenmeyer discloses a carrier provided with partition tabs which extend from the lower end of the handle into the mid portion of the carrier to be secured to the bottom panel of the carrier.

The series of carriers described above are generally made from a flat cardboard blank having suitably placed fold lines for convenient erecting of the carrier on site. The stability of the carrier before and after the carrier is loaded with articles is clearly important for some applications, and this aspect of the carrier is generally assured by providing a broad sturdy base portion as in the Struble and Katzenmeyer carriers. These carriers are heavy duty carriers which are generally designed for heavy-weight articles such as bottled drinks or glass containers. For light-weight articles such as concession cups, light and convenient panel type carriers such as the Brom carrier are preferable from the viewpoints of cost, convenience and conservation of materials.

However, the panel type carriers are not without disadvantages. The carriers in an erected, unloaded condition cannot remain standing on their own due to lack of self-supporting function. This means that a carrier during its loading process must be held by one hand while the other hand is used to load articles into the carrier. Even the carriers in a loaded condition are not sufficiently stable when they are placed on a support surface such as on a counter top, a car seat or the like. These disadvantages are not only inconvenient but also present a potentially hazardous situation, especially in crowded concession stands and fast food outlets.

What is needed, therefore, is a panel type carrier which is stable when loaded and placed on a support surface and which can remain standing on its own even before loaded.

SUMMARY OF THE INVENTION

The present invention in one aspect provides a collapsible carrier for tapered articles. The carrier comprises a pair of upright handle panels secured together in a face-to-face contacting relationship, a pair of divergent upper panels foldably joined respectively to the lower edges of the handle panels, and a pair of convergent lower panels foldably interconnected with the upper panels to form in cooperation with the upper panels a tubular structure defining a tube axis that is generally parallel to the lower edges of the handle panels. Each upper panel has a first article-receiving aperture formed therein and each lower panel has a second article-receiving aperture vertically aligned with the first receiving aperture in the adjacent upper panel. Each one of the upper and lower panels has a width extending perpendicularly to the tube axis. The summation of the widths of the lower panels is less than that of the widths of the upper panels. This geometry of the carrier assures that the carrier when loaded would be stably held in a set up condition by the lower retention panels so that the tubular structure is prevented from collapsing flat.

At least a pair of support legs may be provided for the carrier so that the carrier in an unloaded condition can remain standing by itself on a support surface. Such legs may extend downwardly respectively from the portions of the tubular structure adjacent to the outer lower edges of the upper panels. The support legs may be formed from the material struck from the lower panels to define the second receiving apertures. Alternatively, they may be formed from the material struck from the upper panels to define the first receiving apertures.

The present invention in another aspect provides a carrier comprising a pair of upright handle panels, a pair of divergent upper panels, a pair of convergent lower panels, and a pair of support legs formed from material struck from the upper panels to define first receiving apertures in the upper panels. The support legs are foldably joined at their upper ends respectively to the upper panels near the outer lower edges of the upper panels and extend downwardly respectively through second receiving apertures in the lower panels. The support legs can support the carrier thereon, and thereby allows the carrier to remain standing by itself on a support surface even before the carrier is loaded.

The invention in still another aspect provides a carrier which comprises a pair of upright handle panels, a pair of divergent upper panels, a pair of convergent lower panels, a pair of support legs for supporting the carrier thereon, and a stabilizing structure extending downwardly from the upper panels into the tubular structure that is formed by the upper and lower panels. The stabilizing structure comprises locking means in releasable engagement with the lower panels such that the lower panels are held above a support surface when the carrier is placed on such a support surface. This arrangement assures that when the carrier is loaded and placed on a support surface, the lower panels of the carrier engage the lower portions of the loaded articles. This provides stability to the loaded articles so as to reduce the chance of accidental toppling of the articles.

According to a preferred embodiment in this aspect, the stabilizing structure may be formed of a pair of partition tabs which are independent of the support legs. The tabs may be foldably joined respectively to the upper panels adjacent to the handle panels and extend downwardly.

In an alternative embodiment, the support legs may function also as the stabilizing structure. More particularly, the legs may be foldably joined at their upper ends respectively to the upper panels so as to extend downwardly through the second receiving apertures and may be provided with the locking means.

The present invention in a further aspect provides a carrier which comprises a pair of upright handle panels, a pair of divergent upper panels foldably joined respectively to lower edges of the handle panels along first fold lines, a pair of convergent lower panels, and a pair of partitioning tabs foldably joined respectively to the upper panels along second fold lines. The tabs extend downwardly into the tubular structure that is formed by the upper and lower panels. The second fold lines are disposed at locations spaced outwardly from the first fold lines respectively. The tabs are secured together at its lower portions. This arrangement results in formation of a three-dimensional stabilizing structure bridging between the upper panels, which inhibits the upper panels from spreading too far to retain the carrier in a set up condition.

According to a preferred embodiment in this aspect, the lower panels may be formed with a locking aperture at the position vertically aligned with the stabilizing structure, and the stabilizing structure may be provided at its lower end with locking means for insertion into the locking aperture. The locking means when in the locking aperture engages the outside surface of the lower panels and thereby prevents sagging of the lower panels. The stabilizing structure is relatively stiff due to its constituent tabs having the separated upper portions and the secured lower portions. Such a stiff structure assists the engaging means in being retained at the position in vertical alignment with the locking aperture during the assembly process for the carrier and thereby facilitates the assembly process.

The objects and advantages of the present invention will be apparent from the following description, the accompanying drawings and the appended claims.

DETAILED DESCRIPTION OF THE PREFERRED EMBODIMENTS

Figure 1:
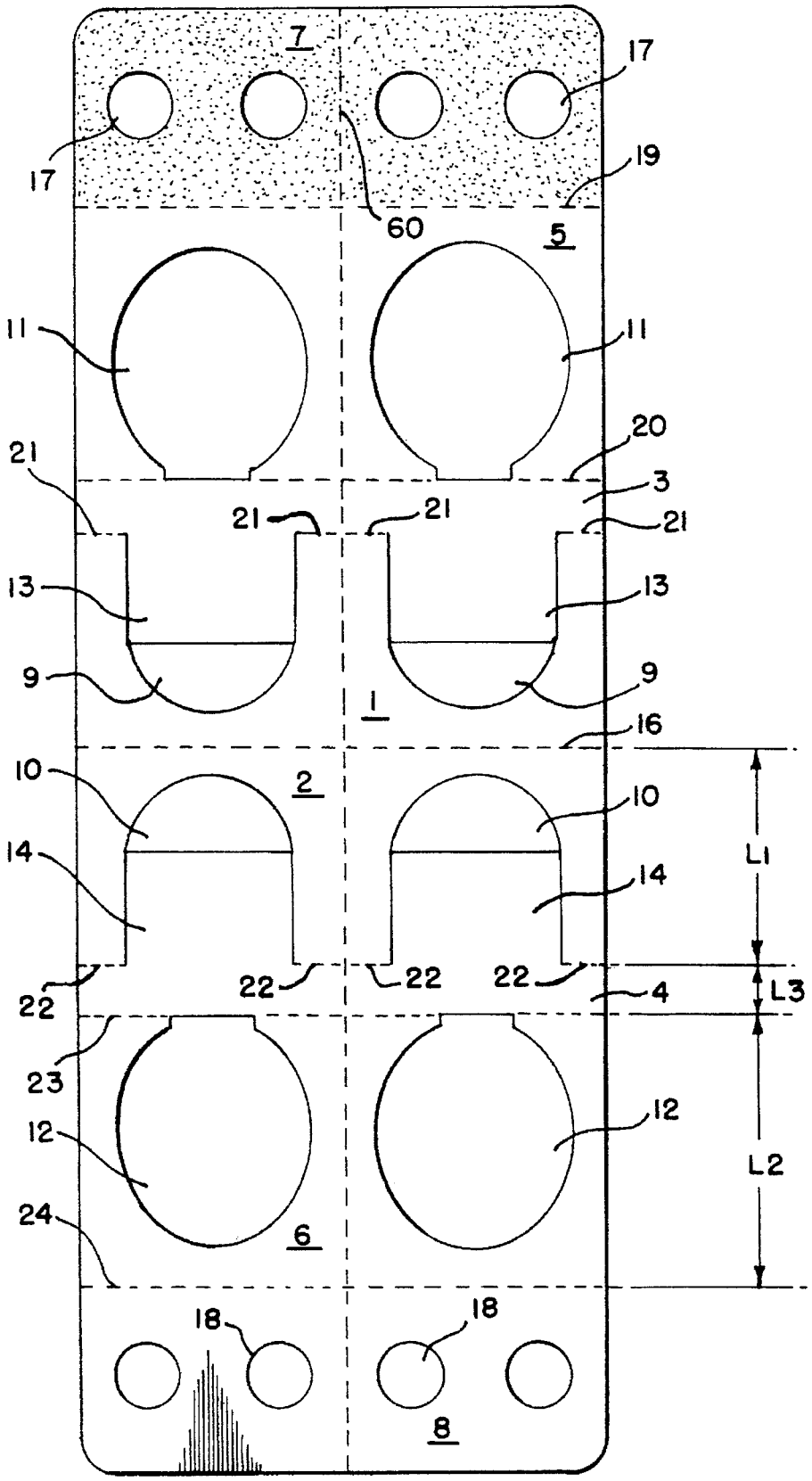
FIG. 1 is a plan view of a blank for forming an article carrier according to the invention.

An article carrier according to the invention is shown in blank form in FIG. 1. The blank is formed from paperboard or similar foldable sheet material and includes a plurality of foldably interconnected panels 1–8 disposed symmetrically with respect to a center fold line 16.

The lower retention panels 1 and 2 are foldably joined together along the fold line 16. The medial strips 3 and 4 are foldably joined respectively to the lower panels 1 and 2 along interrupted fold lines 21 and 22. The upper retention panels 5 and 6 are foldably joined respectively to the medial strips 3 and 4 along interrupted fold lines 20 and 23. The handle panels 7 and 8 are foldably joined respectively to the panels 5 and 6 along fold lines 19 and 24.

The lower retention panels 1 and 2 are equal in width to each other, and so do the upper retention panels 5 and 6. Each lower retention panel is different in width than each upper retention panel. In a preferred embodiment, the summation of the widths $L_1$ of the lower retention panels 1 and 2 is less than the summation of the widths $L_2$ of the upper retention panels 5 and 6. This arrangement defined by the formula, $2L_1<2L_2$, prevents the carrier from collapsing flat when the carrier is set up and loaded with articles. In a more preferred embodiment, the width $L_1$ of each lower panel is greater than the width $L_3$ of each medial strip, and the summation of the widths $L_1$ and $L_3$ is equal to or less than the width $L_2$.

Article-receiving apertures 9 and 10 are defined respectively in the lower retention panels 1 and 2, and upper receiving apertures 11 and 12 are defined respectively in the upper retention panels 5 and 6. Legs 13 and 14 are joined to the medial strips 3 and 4 and extend a specific distance away from the medial strips 3 and 4 towards the center fold line 16. In a preferred embodiment, the legs 13 and 14 are struck respectively from the lower retention panels 1 and 2 to define the apertures 9 and 10. The handle panels 7 and 8 are provided with a plurality of finger apertures 17 and 18 of a size and shape suitable to accommodate fingers of a human hand. The carrier may be split into halves along a tear line 60 to produce two smaller carriers, each of which carries two articles.

Figure 2:
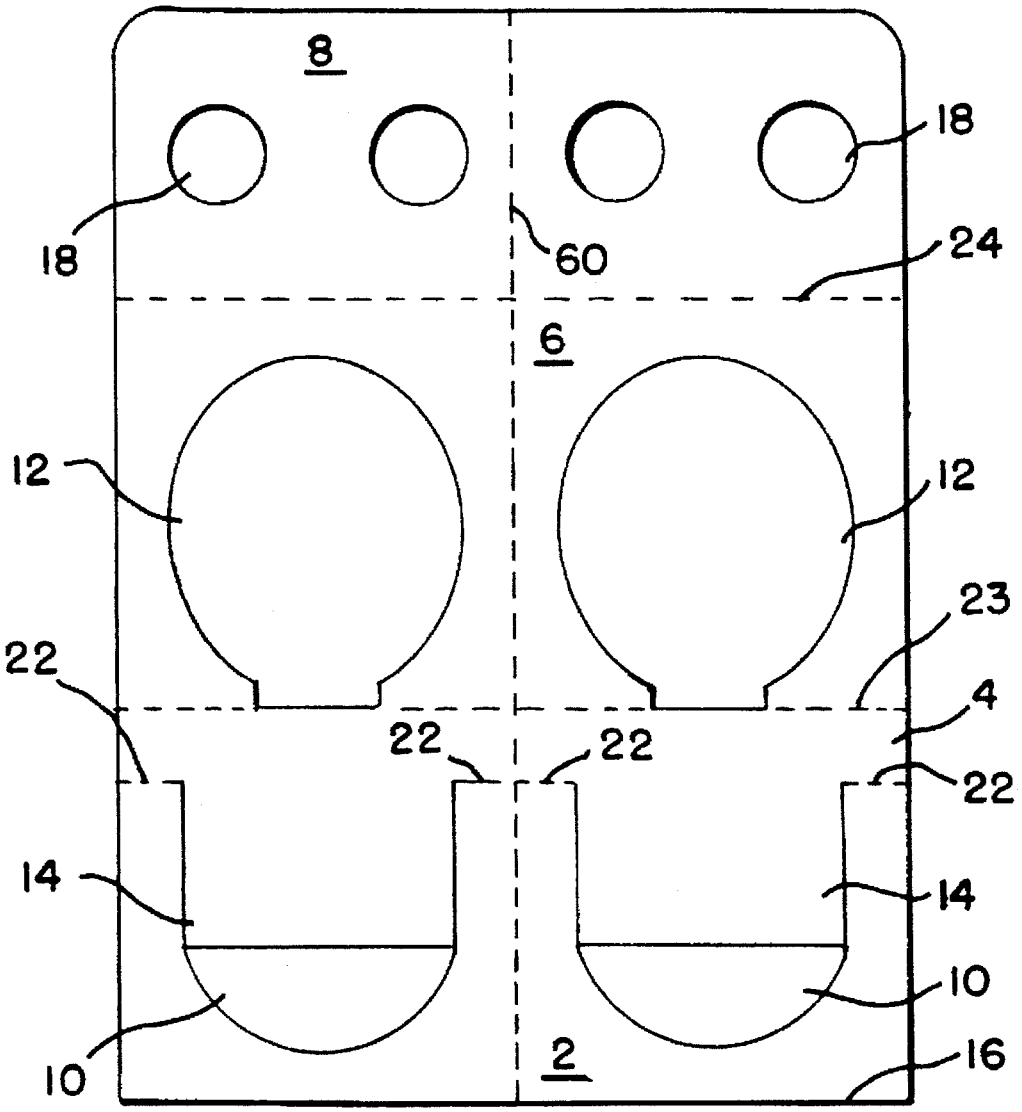
FIG. 2 is a plan view of the blank in FIG. 1, folded double about a center fold line.

To produce a preformed flat carrier from the blank shown in FIG. 1, glue is applied to one of the handle panels 7 and 8 as shown by the stippling in FIG. 1, and then the blank is folded in two about the fold line 16 so that the panels 2, 4, 6 and 8 are placed over the panels 1, 3, 5 and 8, respectively. By this means, the handle panels 7 and 8 are secured together in a face-to-face contacting relationship and produce a composite carrier handle. The resultant flat carrier is shown in FIG. 2 in which the upper panels 5 and 6 as well as the lower panels 1 and 2 are in contact at their inside surfaces with each other. However, the flat carrier may take a form in which the lower panels 1 and 2 and the medial strips 3 and 4 are folded inwardly to a position between the upper panels 5 and 6 so that the outside surfaces of the lower panels 1 and 2 come into contact with each other. The flat storage condition provided by inwardly folding the lower panels may be found by reference to U.S. Pat. No. 3,255,919 which is incorporated herein by reference.

Figure 3:
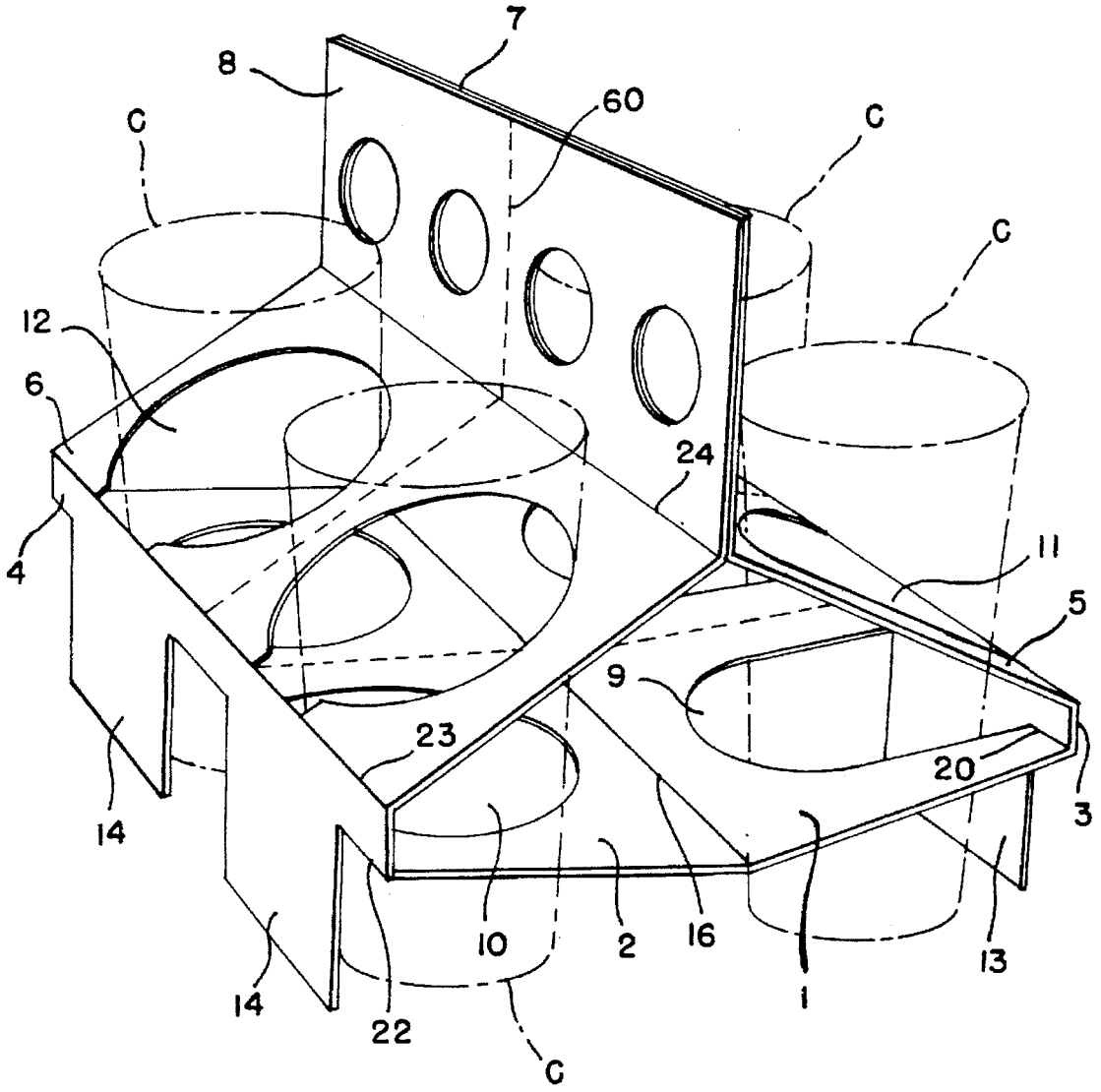
FIG. 3 is a perspective view of the carrier formed from the blank in FIG. 1, showing loaded cups in the phantom line.

The flat carrier as shown in FIG. 2 can be manipulated into a three-dimensional carrier of a tubular structure as shown in FIG. 3 by separating the upper panels 5 and 6 as well as the lower panels 1 and 2 outwardly. More specifically, the upper panels 5 and 6 are folded about the fold lines 19 and 24 with respect to the handle panels 7 and 8 such that they diverge from each other as extending downwardly from the handle. The medial strips 3 and 4 are folded with respect to the upper panels 5 and 6 so as to assume vertical positions generally parallel to the handle panels 7 and 8. Meanwhile, the lower panels 1 and 2 are folded about the fold lines 20 and 22 so as to extend inwardly and downwardly from the medial strips 3 and 4 and converge at the fold line 16. As the lower panels 1 and 2 are folded with respect to the medial strips 3 and 4, the legs 13 and 14 are automatically displaced respectively from the planes of the lower panels 1 and 2 and disposed in vertical positions to support the carrier.

In FIG. 3, the apertures 11 in the upper panel 5 are vertically aligned respectively with the apertures 9 in the lower panel 1. In like manner, the apertures 12 in the upper panel 6 are vertically aligned respectively with the apertures 10 in the lower panel 2. The legs 13 and 14 which extend downwardly from the opposing medial strips 3 and 4 allow the empty carrier to be supported and balanced on them when the carrier is placed on a support surface such as a table top, a seat surface and the like. This permits loading of articles to be performed with relative ease.

While placed on a support surface, the erected carrier may be loaded with tapered articles such as concession cups C by inserting the articles into the respective vertically aligned pairs of receiving apertures as illustrated by the phantom line in FIG. 3. During such a loading process, the support legs 13 and 14 prevent the carrier from sliding down along the side walls of the cups C. This contributes considerably to stability of the cups on the support surface and reduces the chance of accidental toppling of the cups. Furthermore, the arrangement in which the upper panels 5 and 6 are greater in width than the lower panels 1 and 2 prevents the upper panels 5 and 6 from sagging along the side walls of the cups C and thereby retains the carrier in a set up condition. Once a desired number of cups C are loaded, the carrier may be lifted and transported by inserting fingers into the finger apertures in the carrier handle.

It should be recognized that the vertical lengths of the support legs 13 and 14 are generally equal to each other so that the erected carrier is balanced and held upright on the support legs 13 and 14.

It should be also recognized that although the carrier of the invention is used with the drinking cups C in the foregoing embodiment, it may be used with any tapered articles such as glasses, cones, etc. or any flanged articles having outwardly projecting peripheral flanges at their upper portions.

It should be further recognized that the size and shape of the receiving apertures 9, 10, 11 and 12 are such that the articles in the apertures are securely engaged by at least one of the associated upper and lower panels and thus retained in place without being dislodged from the apertures.

FIGS. 4–7 illustrate a modified form of the carrier in FIGS. 1–3. The modified carrier defers from the foregoing carrier in that it is provided with partition tabs 70 and 72 as well as locking apertures or slots 74. The remainder of the carrier is virtually identical to that of the foregoing embodiment. Therefore, those identical portions are identified by the same reference numerals, and description thereof will be omitted hereinbelow.

Figure 4:
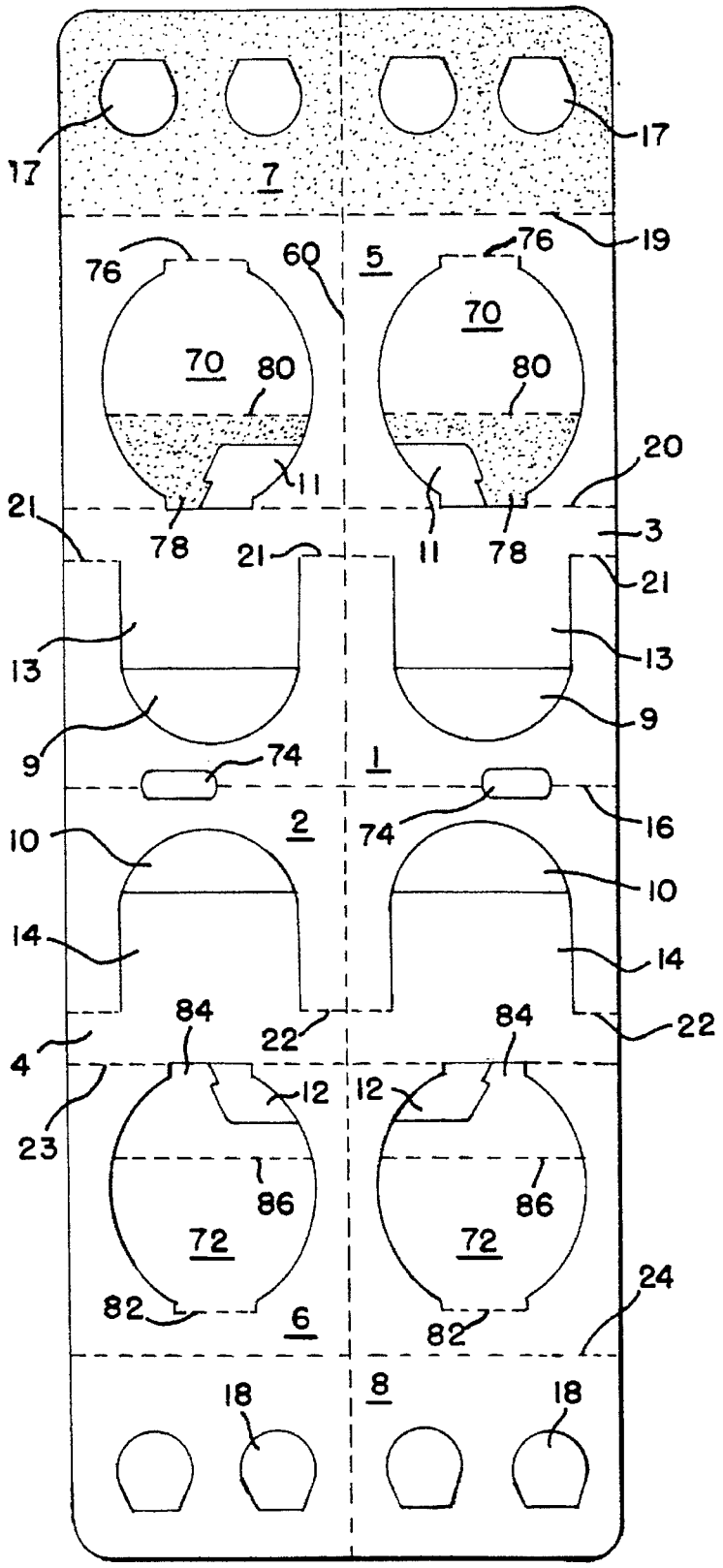
FIG. 4 is a plan view of a blank for forming the carrier of a second embodiment according to the invention.

FIG. 4 shows the carrier in blank form in which the partition tabs 70 are formed from the material struck from the upper panel 5 so that the receiving apertures 11 are defined in the upper panel 5 when the tabs 70 are displaced from the plane of the upper panel 5. The tabs 70 are foldably joined to the upper panel 5 along fold lines 76 which are spaced from and parallel to the fold line 19. Each tab 70 is provided with a transverse fold line 80 and a hook-shaped lower portion 78 defined by the fold line 80 and the lower end of that tab 70. The lower ends of the tabs 70 are longitudinally aligned with the slots 74, respectively. In like manner, the tabs 72 are struck from the upper panel 6 to form the receiving apertures 12 and are foldably joined to the upper panel 6 along fold lines 82 that are parallel and adjacent to the fold line 24. Each tab 72 is provided with a transverse fold line 86 and a hook-shaped lower portion 84. The lower ends of the tabs 72 are longitudinally aligned with the slots 74, respectively. The slots 74 are formed in the lower panels 1 and 2 along the fold line 16 such that the slots 74 interrupt the fold line 16.

To form a flat carrier, glue is applied to the lower portions of the tabs 70 or the tabs 72 as well as to one of the handle panels 7 and 8, as shown by the stippling in FIG. 4. The blank is then folded double about the fold line 16. This secures together the respective lower portions 78 and 84 of the tabs 70 and 72 as well as the handle panels 7 and 8.

Figure 6:
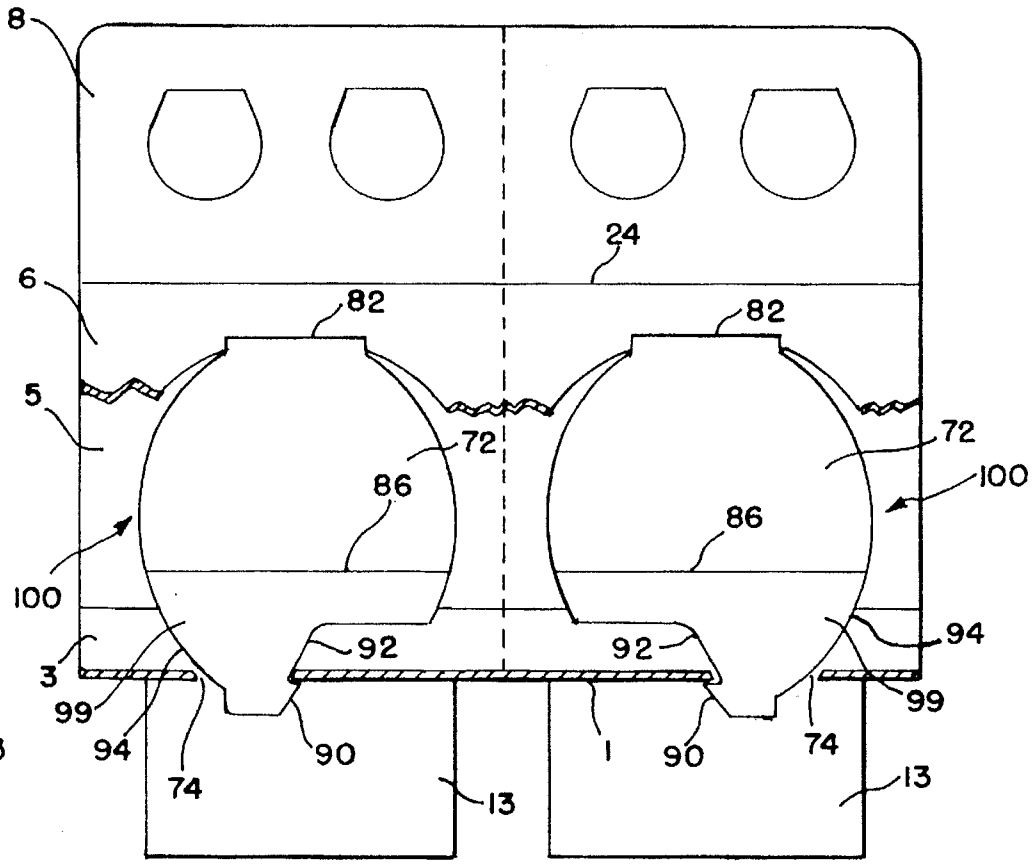
FIG. 6 is a side elevation, partially cut away, of the carrier formed from the blank in FIG. 4.
Figure 5:
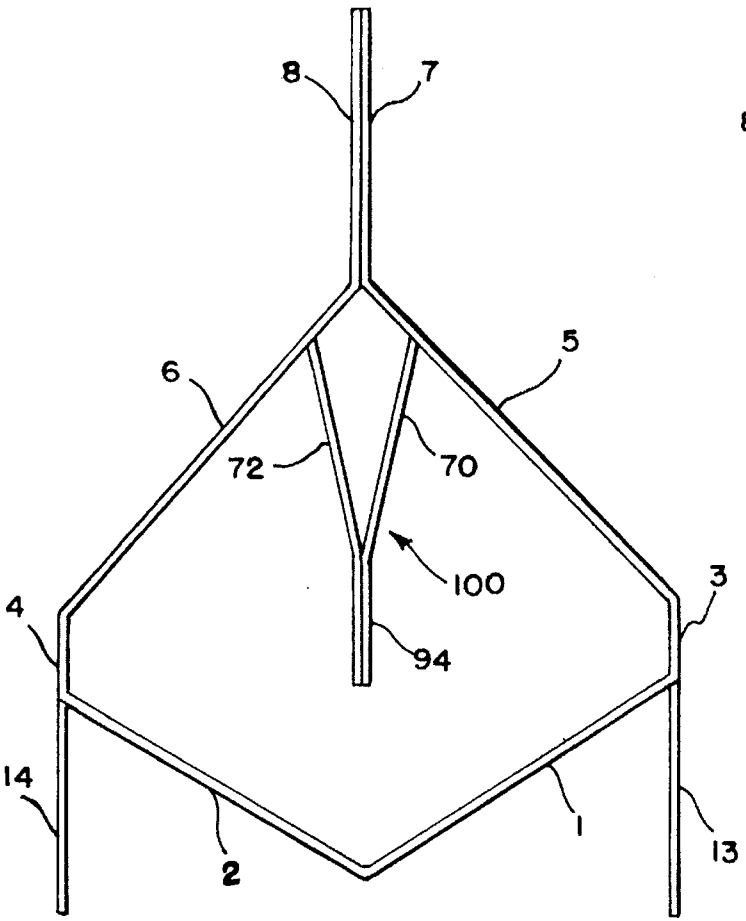
FIG. 5 is an end view of a partially erected form of the carrier formed from the blank in FIG. 4.

Erection of the flat carrier is achieved by simply separating outwardly the upper panels 5 and 6 as well as the lower panels 1 and 2. As the upper panels 5 and 6 are pivoted away from each other, the upper portions of each secured pair of partition tabs 70 and 72 are separated from each other while their lower portions 78 and 84 remain secured together. This is best shown in FIG. 5 in which the tabs 70 and 72 create a three-dimensional stabilizing structure 100 which bridges between and extends downward from the divergent upper panels 5 and 6. Each structure 100 has at its lower end a double-wall locking hook 99 that is disposed at a position vertically aligned with the respective slot 74. As best shown in FIG. 6, the hook 99 of each stabilizing structure includes a foot having a sloping edge 90 and a shank having opposing side edges 92 and 94 extending divergently toward the fold line 86. The maximum distance between the side edges 92 and 94 is greater than the length of each slot 74, which permits the shanks to function as stoppers which will be described later in detail.

By further separating the upper panels 5 and 6, the stabilizing structures 100 are lowered, and the feet of the hooks 99 are brought into abutment at their sloping edges 90 accurately against the respective perimeters of the locking slots 74. This accurate positioning of the feet against the perimeters is due to the stiffness of the three-dimensional stabilizing structures 100, which retains the feet in vertical alignment with the slots 74 despite the movement of the other portions of the carrier during the assembly. Pressed against the perimeters, the feet are guided smoothly by the sloping edges 90 into the respective slots 74 and snap into engagement with the lower surfaces of the lower panels 1 and 2, as shown in FIG. 6. By this means, the carrier is completely assembled and retained stably in the assembled condition as best shown in FIG. 7.

Stability and integrity of the erected carrier of this embodiment, either in a loaded or unloaded condition, is somewhat higher than that of the first embodiment because of the structures 100 that restrain mutual upward and downward movement of the upper and lower panels. More particularly, the feet of the hooks 99 prevent upward movement of the upper panels 5 and 6 as well as downward movement of the lower panels 1 and 2, whereas the shanks of the hooks 99, when coming into abutment with the perimeters of the slots 74, function as stoppers and prevent downward movement of the upper panels 5 and 6 as well as upward movement of the lower panels 1 and 2. Furthermore, the structures 10 as connecting between the upper panels 5 and 6 inhibit the panels 5 and 6 from spreading too far.

Figure 7:
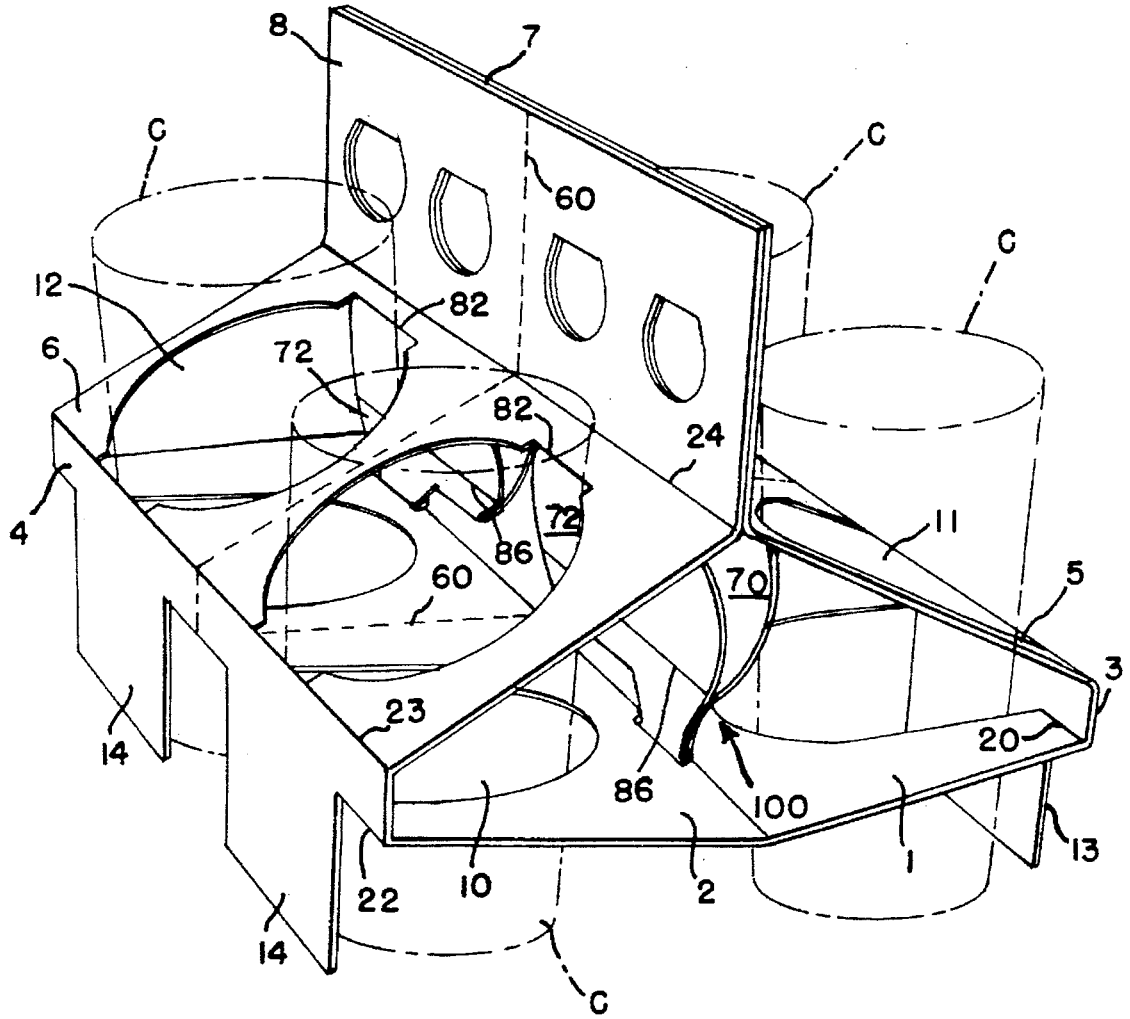
FIG. 7 is a perspective view of the carrier formed from the blank in FIG. 4, showing loaded cups in the phantom line.

The high stability of the carrier also provides higher stability to the loaded articles such as at C in FIG. 7. Due to the structures 100 with the hooks 99, it is insured that the lower panels 1 and 2 are retained substantially above a support surface when the carrier is placed on such a surface. This significantly reduces accidental toppling of the loaded articles.

It should be recognized that although in the above embodiment, the partition tabs are partially glued, it may be that partition tabs in face-to-face contacting relationship along their entire inner surfaces may be used with the present invention. Such partition tabs may be found by reference to U.S. Pat. No. 3,744,704 which is incorporated herein by reference.

Figure 8:
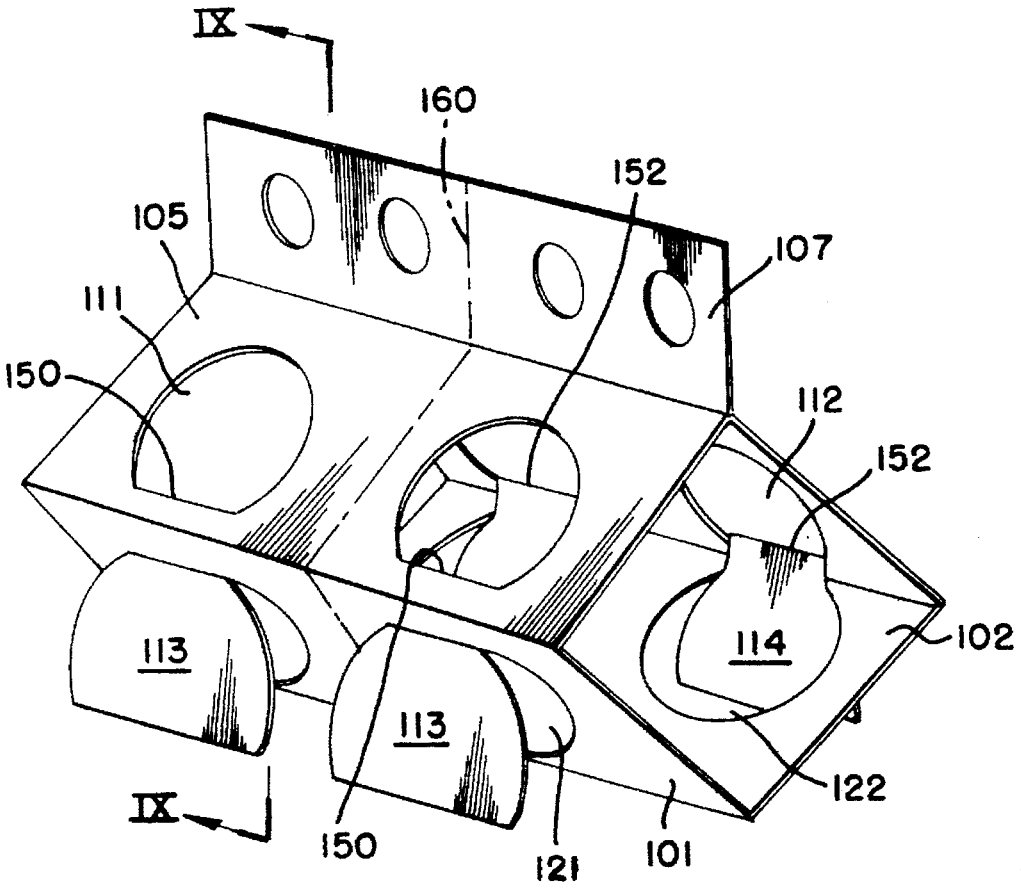
FIG. 8 is a perspective view of a third embodiment of the carrier according to the present invention.
Figure 9:
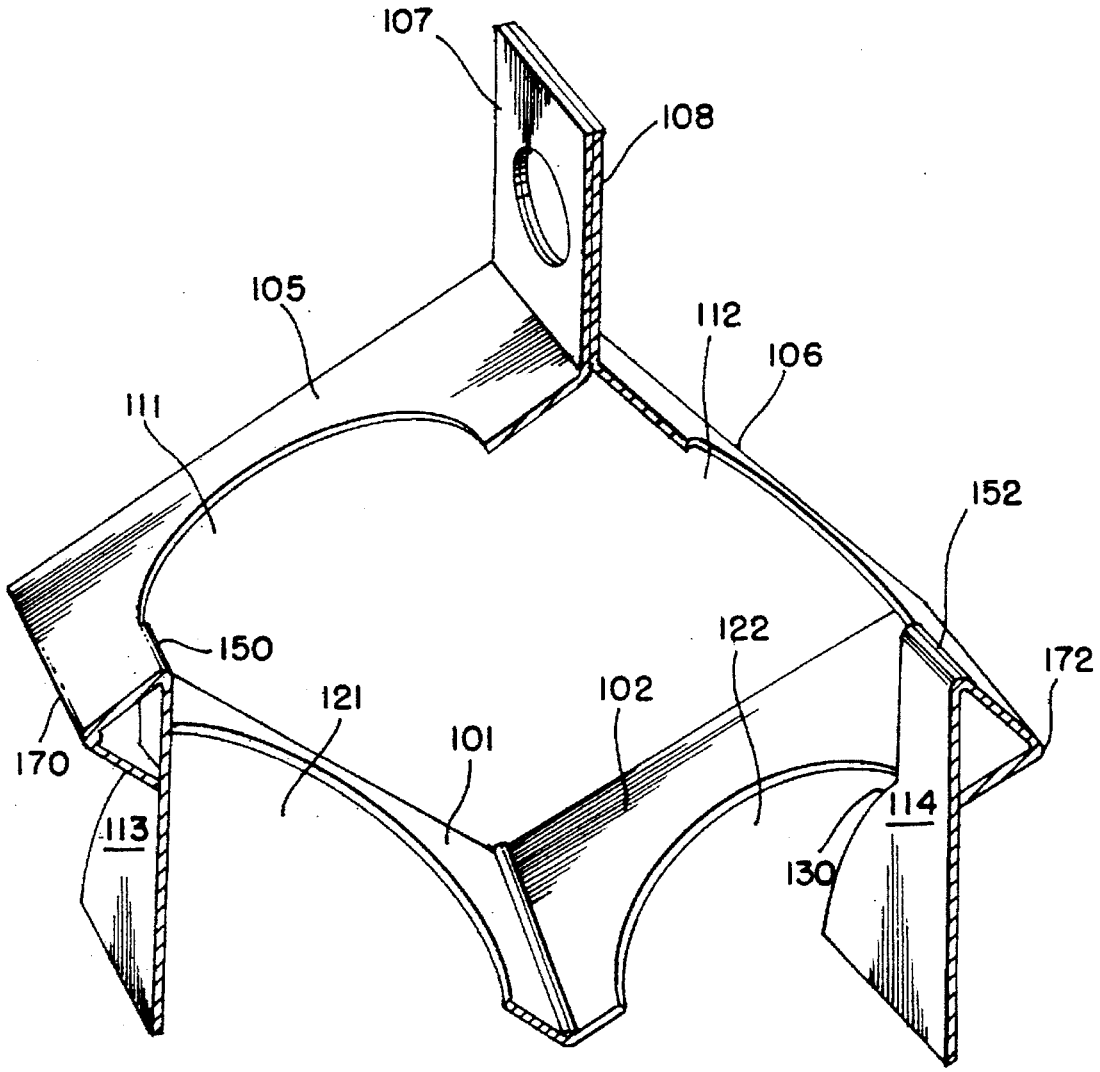
FIG. 9 is an enlarged fragmentary perspective view of the carrier in FIG. 8, showing the cross section along the line IX—IX in FIG. 8.

FIGS. 8 and 9 illustrate a modified form of the carrier shown in FIGS. 4–7, wherein the support legs function also as stabilizing structures.

In FIG. 8, the support legs 113 and 114 are formed from the material struck from the upper panels 105 and 106 to define the receiving apertures 111 and 112 in the upper panel 105 and 106. The legs 113 and 114 are foldably joined at their respective upper ends to the upper panels 105 and 106 along fold lines 150 and 152 adjacent to the outer lower edges of the upper panels 105 and 106. This arrangement allows quick and efficient assembly process for the carrier because by simply inserting articles into the receiving apertures 111 and 112, the legs 113 and 114 are automatically folded downward into the receiving apertures 121 and 122 and project downwardly to support the carrier thereon. The broken line 160 designates a tear line for splitting the carrier into two smaller carriers.

Referring to FIG. 9, the medial strips are eliminated from the carrier, and thus the lower panels 101 and 102 are directly joined at their outer upper edges to the outer lower edges of the upper panels 105 and 106 along fold lines 170 and 172. The lower panels 101 and 102 are disposed at an angle with respect to the upper panels 105 and 106, respectively. Each leg is provided with a locking shoulder 130. The shoulders 130 of the legs 113 and 114 engage the outer or lower surfaces of the respective lower panels 101 and 102, and thereby each upper panel and adjacent lower panel are prevented from spreading too far from each other. This in other words restrains the mutual movement of the upper and lower panels and thereby helps the carrier to be retained in a set up condition.

What is claimed is:

1. A collapsible carrier for tapered articles, comprising:

a pair of upright handle panels secured together in a face-to-face contacting relationship;

a pair of divergent upper panels foldably joined respectively to lower edges of said handle panels, each of said upper panels having a first article-receiving aperture formed therein; and a pair of convergent lower panels foldably interconnected with said upper panels to form in cooperation with said upper panels a tubular structure defining a tube axis generally parallel to said lower edges of said handle panels, each of said lower panels having a second article-receiving aperture vertically aligned with said first receiving aperture in adjacent one of said upper panels, each of said upper and lower panels having a width extending perpendicularly to said tube axis, the summation of said widths of said lower panels being less than that of said widths of said upper panels so as to prevent said tubular structure from collapsing flat when at least one of vertically aligned pairs of said first and second receiving apertures is loaded with an article.

2. The carrier according to claim 1, further comprising a pair of support legs extending downwardly respectively from portions of said tubular structure adjacent to outer lower edges of said upper panels so as to support said carrier thereon.

3. The carrier according to claim 2, wherein said support legs are formed from material struck from said lower panels to define said second receiving apertures.

4. The carrier according to claim 2, wherein said support legs are formed from material struck from said upper panels to define said first receiving apertures, said support legs being foldably joined at upper ends thereof respectively to said upper panels near said outer lower edges of said upper panels.

5. The carrier according to claim 1, wherein said lower panels are foldably joined respectively to outer lower edges of said upper panels and are foldably joined together along inner lower edges thereof.

6. The carrier according to claim 1, further comprising a pair of medial strips extending generally parallel to said tube axis, said medial strips being foldably joined respectively to outer lower edges of said upper panels, said lower panels being foldably joined respectively to lower edges of said medial strips and being foldably joined together along inner lower edges thereof.

7. A carrier for tapered articles, comprising:

a pair of upright handle panels secured together in a face-to-face contacting relationship;

a pair of divergent upper panels foldably joined respectively to lower edges of said handle panels, each of said upper panels having a first article-receiving aperture formed therein;

a pair of convergent lower panels foldably interconnected with said upper panels to form in cooperation with said upper panels a tubular structure, each of said lower panels having a second article-receiving aperture vertically aligned with said first receiving aperture in adjacent one of said upper panels, said lower panels being foldably joined together along inner lower edges thereof and being formed with a locking aperture at a position along said inner lower edges; and a stabilizing structure extending downwardly from said upper panels into said tubular structure, said stabilizing structure being provided at a lower end thereof with locking means for insertion into said locking aperture such that said locking means when in said locking aperture engages an outside surface of said lower panels, said stabilizing structure being provided with a stopper portion for engagement with an inside surfaces of said lower panels, said stopper portion being interposed between said lower end of said stabilizing structure and an upper end of said stabilizing structure.

8. The carrier according to claim 7, wherein said locking means comprises a sloping guide edge for abutment against a perimeter of said locking aperture and guiding said locking means into said locking aperture during assembly of said carrier whereby said assembly is facilitated.

9. The carrier according to claim 7, wherein said stabilizing structure comprises a pair of partition tabs foldably joined respectively to said upper panels and extending downwardly, said tabs being secured together at lower portions thereof, and said locking means comprises a hook formed by said lower portions of said tabs.

10. The carrier according to claim 9, wherein said partition tabs are joined to said upper panels along fold lines parallel to said lower edges of said handle panels, and said stopper portion has a horizontal dimension greater than the length of said locking aperture along said inner lower edges of said lower panels.

11. The carrier according to claim 9, wherein said tabs are formed from material struck from said upper panels to define said first receiving apertures.

12. A carrier for tapered articles, comprising:

a pair of upright handle panels secured together in a face-to-face contacting relationship;

a pair of divergent upper panels foldably joined respectively to lower edges of said handle panels along first fold lines, each of said upper panels having a first article-receiving aperture formed therein;

a pair of convergent lower panels foldably interconnected with said upper panels to form in cooperation with said upper panels a tubular structure, each of said lower panels having a second article-receiving aperture vertically aligned with said first receiving aperture in adjacent one of said upper panels; and a pair of partition tabs foldably joined respectively to said upper panels along second fold lines and extending downwardly into said tubular structure, said second fold lines being disposed at locations spaced outwardly from said first fold lines respectively, said tabs being separated at upper portions thereof from each other and secured together at lower portions thereof so as to form a stabilizing structure for inhibiting said upper panels from spreading far from each other.

13. The carrier according to claim 12, wherein said tabs are formed from material struck from said upper panels to define said first receiving apertures.

14. The carrier according to claim 13, wherein said lower panels are foldably joined together along inner lower edges thereof and are formed with a locking aperture at a position vertically aligned with said stabilizing structure, and said stabilizing structure is provided at a lower end thereof with locking means for insertion into said locking aperture such that said locking means when in said locking aperture engages an outside surface of said lower panels and prevents downward movement of said lower panels.

15. The carrier according to claim 14, wherein said locking means comprises a hook formed by said lower portions of said tabs.

16. The carrier according to claim 14, wherein said stabilizing structure is provided with a stopper portion for engagement with an inside surfaces of said lower panels so as to prevent upward movement of said lower panels, said stopper portion being interposed between said lower end of said stabilizing structure and said second fold lines.

17. The carrier according to claim 16, wherein said lower panels are joined together along a third fold line parallel to said first fold lines, said locking aperture is a slot formed along said third fold line such that said slot interrupts said third fold line, and said stopper portion has a horizontal dimension greater than the length of said slot.

18. The carrier according to claim 14, wherein said locking means comprises a sloping guide edge for abutment against a perimeter of said locking aperture and guiding said locking means into said locking aperture when said stabilizing structure is lowered with respect to said lower panels.

19. The carrier according to claim 14, further comprising a pair of support legs extending downwardly respectively from portions of said tubular structure adjacent to outer lower edges of said upper panels so as to support said carrier thereon such that said lower panels are held above a support surface when said carrier is placed on said support surface.

* * * * *